US007361256B2

(12) United States Patent
Henry et al.

(10) Patent No.: US 7,361,256 B2
(45) Date of Patent: Apr. 22, 2008

(54) ELECTROLYTIC REACTOR

(75) Inventors: David Henry, Le Touvet (FR); Christel Dieppedale, Crolles (FR); Thierry Terrier, Grenoble (FR); Gerard Barrois, Le Fontanil (FR)

(73) Assignee: Commissariat a l'Energie Atomique, Paris (FR)

( * ) Notice: Subject to any disclaimer, the term of this patent is extended or adjusted under 35 U.S.C. 154(b) by 334 days.

(21) Appl. No.: 10/519,847

(22) PCT Filed: Jul. 17, 2003

(86) PCT No.: PCT/FR03/02261

§ 371 (c)(1),
(2), (4) Date: Jan. 13, 2005

(87) PCT Pub. No.: WO2004/009877

PCT Pub. Date: Jan. 29, 2004

(65) Prior Publication Data

US 2005/0247556 A1 Nov. 10, 2005

(30) Foreign Application Priority Data

Jul. 19, 2002 (FR) ..... 02 09199

(51) Int. Cl.
*C25B 13/00* (2006.01)
*C25B 15/00* (2006.01)
*C25C 3/08* (2006.01)

(52) U.S. Cl. ..... 204/237; 204/298.14; 204/298.15; 204/298.23; 204/242; 204/280

(58) Field of Classification Search ..... 204/298.14, 204/298.15, 298.23, 242, 280
See application file for complete search history.

(56) References Cited

U.S. PATENT DOCUMENTS 3,856,652 A * 12/1974 Fleischmann et al. ..... 204/268
5,486,272 A * 1/1996 Hemsley et al. ..... 205/77
5,516,412 A * 5/1996 Andricacos et al. .... 204/224 R
5,980,706 A * 11/1999 Bleck et al. ..... 204/297.14
6,365,016 B1 * 4/2002 Iacovangelo et al. .. 204/192.38
6,547,951 B1 * 4/2003 Maekawa ..... 205/688
7,087,144 B2 * 8/2006 Herchen ..... 204/297.1

FOREIGN PATENT DOCUMENTS

JP 2000-034599 2/2000

* cited by examiner

*Primary Examiner*—Alexa D. Neckel
*Assistant Examiner*—Zulmariam Mendez
(74) *Attorney, Agent, or Firm*—Oblon, Spivak, McClelland, Maier & Neustadt, P.C.

(57) ABSTRACT

An electrolytic reactor including a conical recess of removable slices through which the electrolyte circulates towards a part to be coated under the action of a pump setting up forced circulation. The part is polarized to act as a cathode, facing a coaxial anode in the recess. This configuration leads to good electrolyte flow in front of the part, allowing accelerated deposit with a uniform thickness of the coating material, and dimensions of the chamber may be added.

27 Claims, 5 Drawing Sheets

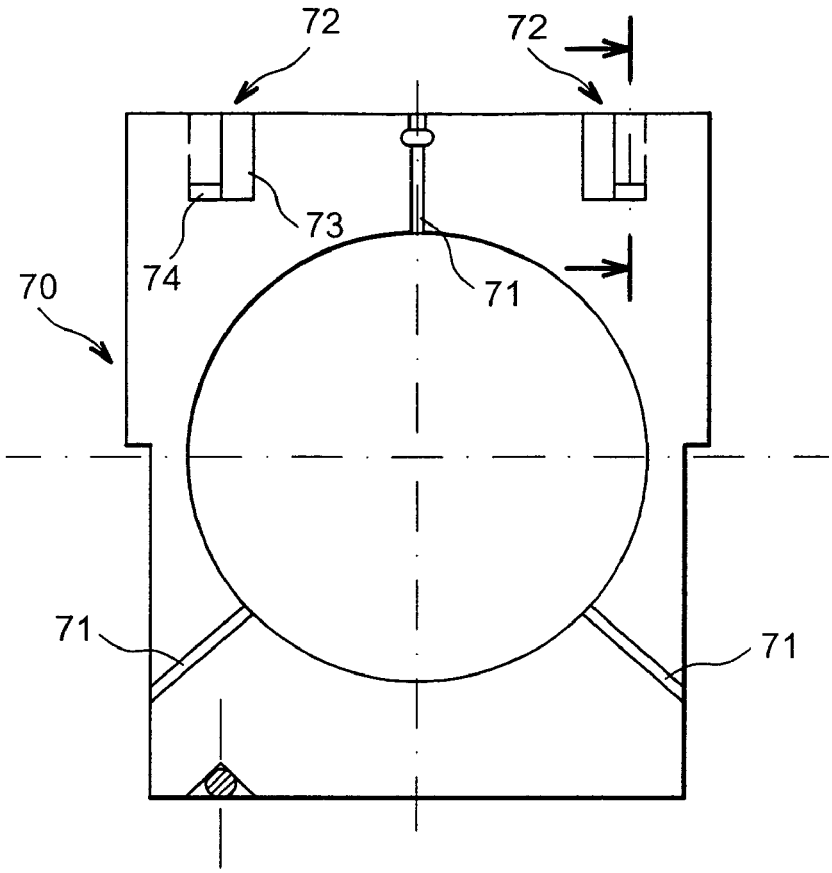
FIG. 5
FIG. 7
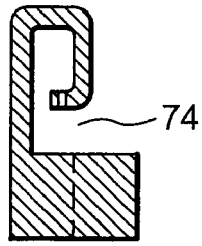
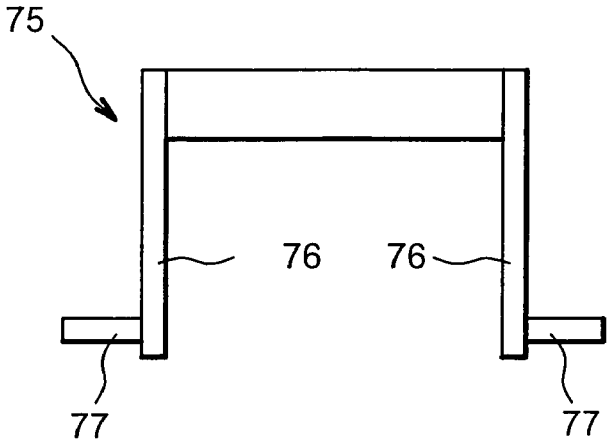
FIG. 6

ELECTROLYTIC REACTOR

This presentation deals with an electrolytic reactor, used particularly for a surface coating application for a part used as an electrode.

Part coating by an electrolytic method is a well known technique that has the advantage that it is inexpensive while in some cases it can be used to make deposits a few tens of microns thick, for example for copper. Furthermore, it is easy to use this technique. Therefore it is used in preference to other techniques particularly for deposits made by sputtering or evaporation, in applications in which there is a competition between the different techniques, such as for manufacturing parts in the micro-electronics and micro-mechanics fields.

However it is not always sure that the electrolytic coating will be formed satisfactorily. Defects that can occur include unequal thickness over the surface or excessively slow growth of the electrolytically deposited material. Furthermore, providing an appropriate process, in other words for which the parameters give a satisfactory and reproducible result for the envisaged application, is not easy and these parameters vary considerably with the application, which is particularly undesirable for micro-systems which require highly dissimilar deposits. Finally, it is sometimes desirable to apply a magnetic field to the coating to make a particular deposit with, a preferred magnetic orientation of the material. This means placing a magnet around the cathode or around the reactor, and therefore limiting its size, and in practice fixing the cathode to prevent alteration of the corresponding magnetic characteristics of the material.

Thus, the following parameters have been found to be essential to obtain a uniform thickness deposit; the electrolyte, and particularly its conductivity; the current density under continuous conditions or parameters of its pulses under pulsed conditions; the geometric arrangement of the reactor, and particularly its size and shape; and the relative positions and sizes of the electrodes; finally stirring and circulation conditions of the electrolyte close to the part to be coated.

Displacement of chemical species in the electrolyte takes place by migration which depends on the applied potential difference between the electrodes, diffusion which depends on differences in the concentration in the electrolyte, or convection which depends on stirring of the bath. But the predominant phenomenon at the location of the coating is diffusion. Therefore, homogenous concentration of the material in the electrolyte from which the coating is made is necessary in front of the surface to be coated.

One known method of promoting circulation of the electrolyte and its renewal in front of the surface to be coated consists of moving a vane in front of the surface to be coated to stir the electrolyte. Another method consists of circulating the electrolyte in a circuit using a pump, this circuit passing in front of the surface. Theses methods are illustrated in U.S. Pat. No. 5,516,412.

These methods frequently give acceptable results, but they tend to cause turbulent stirring of the bath and therefore are not suitable for all situations, and improvements are desirable.

The basic purpose of the invention is to make the electrolyte flow uniform, particularly in front of the part to be coated, and to make the electric polarisation uniform to increase the uniformity of the coating and its deposition rate.

Thus in its most general form, the invention relates to an electrolytic reactor characterised in that it comprises a conical chamber open at two opposite ends, a support of a part to be coated (cathode) and a counter-electrode (anode) placed in the chamber or possibly at the exit from the chamber, towards the wide and the narrow end respectively, and a means of circulating the electrolyte through the chamber from the narrow end to the wide end.

The progressive spreading of the flow towards the part to be coated, initiated well on the input side of this end, contributes to this purpose.

The chamber is composed of stacked slices and a slice support and clamping armature such that the reactor has very attractive modularity properties when it is applied to other parts with different dimensions requiring different geometric deposition parameters. The flow is more regular in the conical chamber than at its exit, which is why it is preferable to put the part to be coated in the conical chamber rather than at the said exit, even if acceptable results can still be obtained at the exit. Slices are provided at the openings easily containing the part to be coated and its support. This modularity is increased if at least one of the slices contains a cavity in which the anode or its support can be placed, since it becomes possible to adjust the position of the anode or to change its shape. It is preferable if a large number of slices should have this property. Modularity can be used to adapt the device to a part to be coated with a given shape or surface area, or to modify the distribution of current lines leading to the part (which is called the "diaphragm effect" described later). In the first case, slices 7 are added or removed on the upstream side of the part; and in the second case they are added or removed on the downstream side of the part.

It is recommended that the taper angle of the conical chamber should be uniform and less than 20°, while less than 14° is even better; the electrolyte circulation should be coaxial with the conical chamber within a tank containing the said chamber, and the device should comprise an electrolyte circuit looping back into the tank; and also the electrolyte circuit should be connected to the narrow end of the chamber through a nozzle with a conical opening prolonging the chamber; all these measures thus contribute to making the flow uniform.

Another improvement relates to the cathode (the part to be coated) and its support, since it is required that the means of fixing the part onto the support should only slightly disturb the flow and should not form any major relief. The arrangement proposed for this purpose consists of fixing the part with the same electrical contacts that polarise them; the support of the part to be coated then comprises electrical contacts for cathode polarisation of the part arranged around the support and that include a free end pressed in contact on the part, and a connection end extending on a support face opposite the part. One ingenious embodiment is characterised in that the connection ends of the electrical contacts are connected to flexible arms of a star connector, fixed to the support by a mechanism with variable spacing, and in that the support includes stops on which the arms bend, and the electrical contacts are in the form of curved hooks standing up on the arms.

The flow at this location is even better if the part to be coated and its support form a common smooth surface, namely if the part support comprises a housing with a periphery and depth adjusted to the part.

Finally, modularity is further improved if it also relates to the cathode holder, namely if the part support is installed removably on an armature delimiting the conical chamber.

One essential feature of the invention is based on the fact that the conical chamber, the support of the part to be coated, the part itself, the anode and also preferably the arms of the circuit through which electrolyte is circulated through the chamber, are coaxial so as to more easily reach the target objectives; therefore the anode and cathode electrodes are suspended at the centre of the chamber.

The invention will now be described in more detail with reference to the figures:

FIG. 5 illustrates another slice;

FIG. 6 illustrates a detail of this slice;

FIG. 7 illustrates a complementary handling means;

Figure 1:
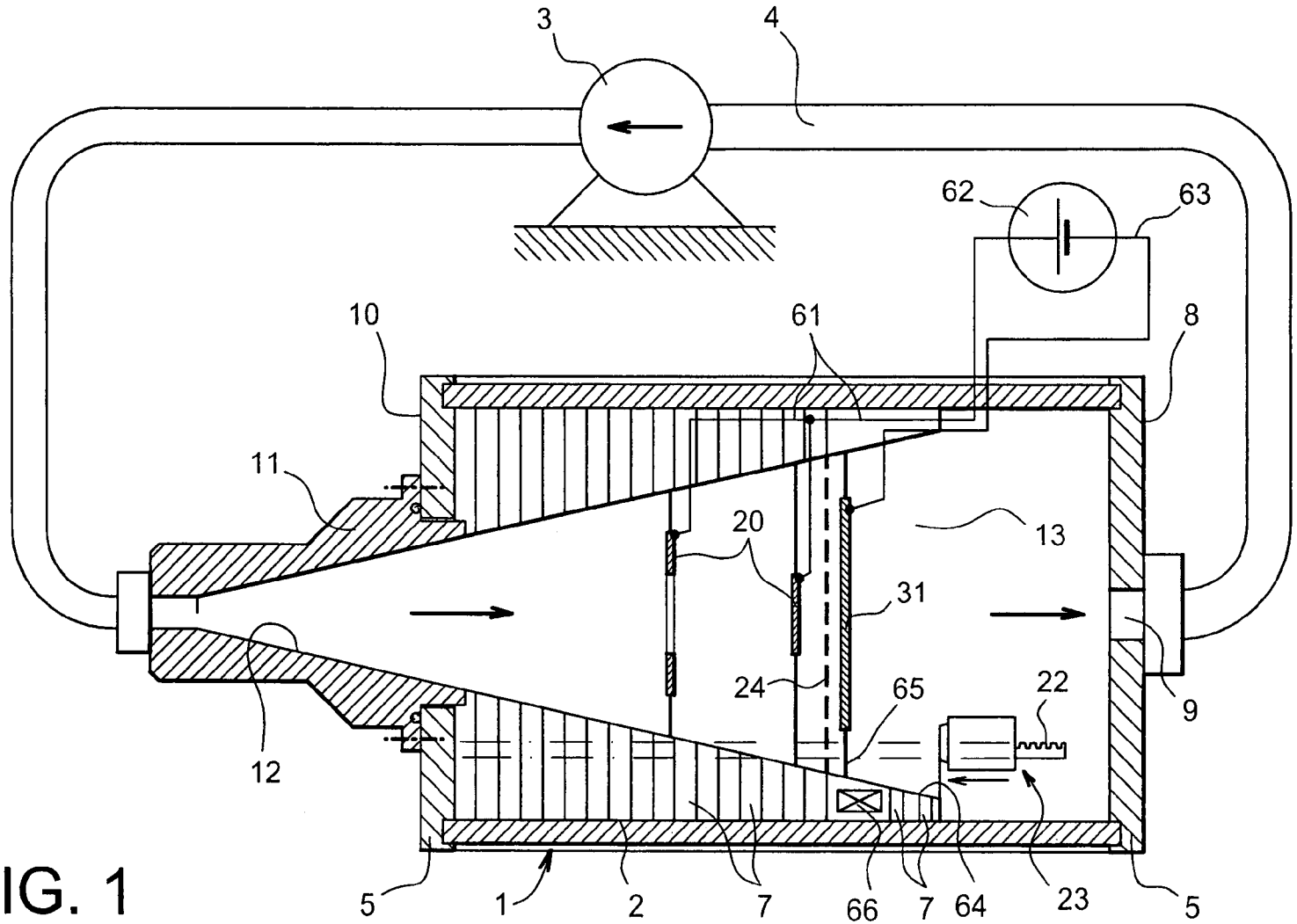
FIG. 1 shows a global view of the reactor.

We will now consider the complete description of the invention with reference to the figures. The invention includes a tank 1 filled with electrolyte and also containing a structure that forms the reactor 2 itself, in other words the location at which the electrolysis takes place and at which the coating is formed. A pump 3 circulates the electrolyte through a pipe loop 4, the ends of which are connected onto opposite orifices of the tank 1, creating circulation through the reactor 2. The tank 1 comprises stands 5 used to place it on a table or another surface. The stands 5 are thus used to tilt the tank 1 to perform emptying or maintenance operations. The reactor 2 is composed of a series of slices 7 stacked on each other or adjacent to each other, for which the outer edges are uniform. The slices 7 all comprise a central conical recess, and these recesses prolong each other to form a global conical recess 13 (chamber) narrowing on one side at which the reactor 2 is adjacent to a side of the tank 1 and widening towards the opposite side of the tank 1, but without reaching it. This second side 8 contains an orifice 9 through which the electrolyte is drawn into the pipe 4, while the side 10 described above is fitted with an injection nozzle through which the electrolyte is sent into the reactor 2; the nozzle 11 also comprises a conical recess 12 that fits to the conical recess 13 of the reactor 2.

Figure 2:
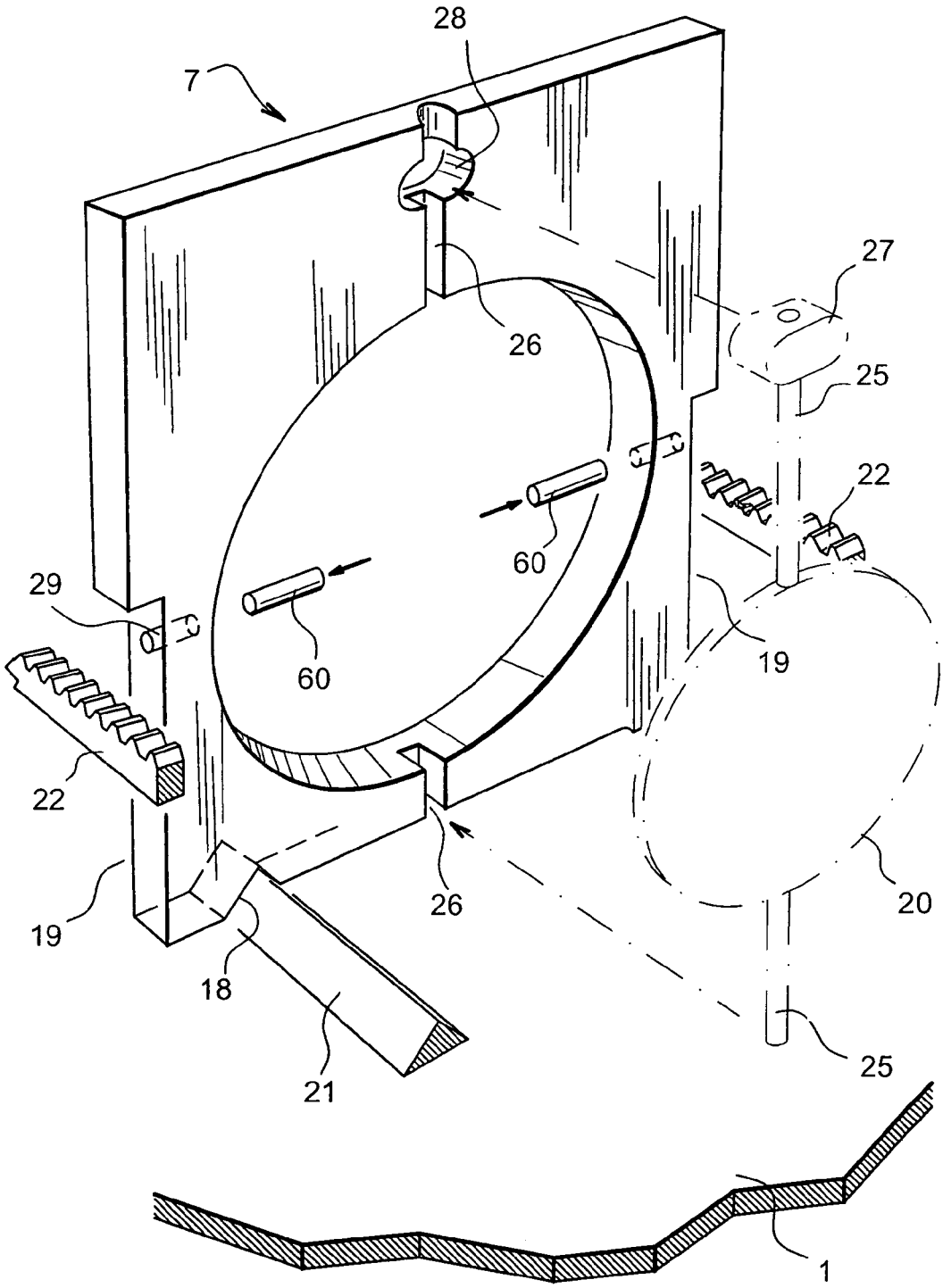
FIG. 2 illustrates a slice delimiting the reactor chamber, and adjacent parts.

The slices 7 are approximately square, and are provided with a few notches like the slice shown in full in FIG. 2. One of these notches is triangular and is marked with reference 18 and the technician uses it to place the slices 7 suitably in tank 1, by adjusting the notch 18 onto a slide 21 placed on the bottom of the tank 1. There are two other notches 19 on the opposite sides of the slices 7 and are used to slide the slices on racks 22 fixed to the walls of the tank 1 and on which a blocking carriage 23 is made to slide compressing the stack of slices 7 in the reactor 2. The slice 7 shown in the figure will be used to fix an anode 20 for which only the silhouette is shown in the figure and that may be a disk, a ring, a grid or any other structure depending on the distributions of electrical current lines and electrolyte flow lines to be set up. A solid anode 20 can reduce excess flow at the centre and an ring-shaped anode 20 around the surface can concentrate the deposit of material in front of it, in other words close to the periphery of the part to be coated. One interesting arrangement then consists of using a plurality of concentric anodes 20, extending at different radii and placed on various slices 7 of the reactor 2, as illustrated by FIG. 1. If several anodes 20 are used at the same time, they could be polarised independently in order to apply different currents on each of them and thus compensate for any edge effects on the cathode.

Any bubbles present in the electrolyte (such as hydrogen generated by the electrochemical reaction) can be captured with a diffusion grid 24 without electrical properties placed in front of the cathode.

Regardless of the selected configuration, the anode 20 is housed in the slice 7 assigned to it by arms 25 that are inserted in vertical notches 26 opposite the slice 7. The upper arm 25 contains an electricity conductor 61 and finishes on a connector 27 forced into a hollow 28 of the slice 7. The slice 7 also includes drillings 29 at mid-height in the horizontal direction and into which pins 60 are fitted preventing the anode 20 from pivoting. The connector 27 holds a wire 61 leading to the positive terminal of a dc current generator 62 illustrated in FIG. 1; the wire 61 is sheathed so that its length is immersed in the tank, except for the end that fits into the connector 27.

Figure 3:
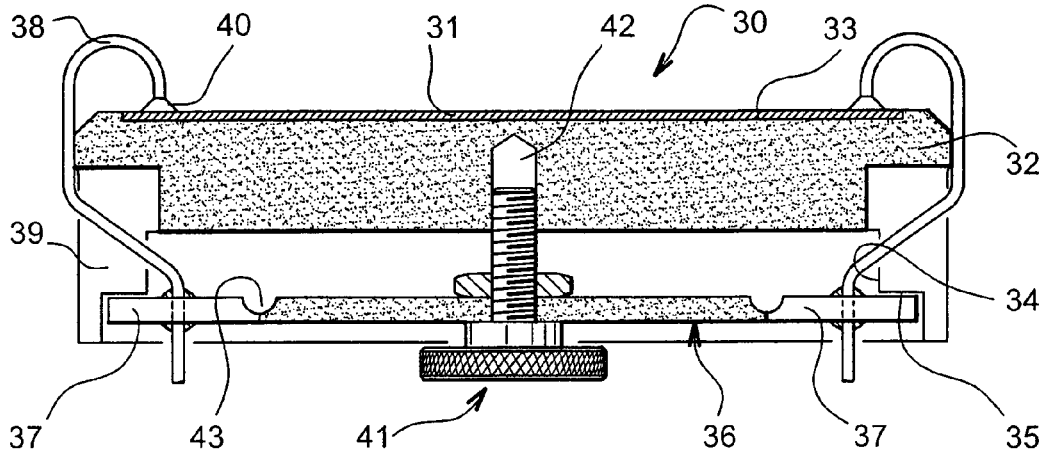
FIGS. 3 and 4 illustrate two states of the cathode holder.

FIG. 3 shows details of the cathode holder 30 (part support). It is known that the part itself for which the surface is to be coated acts as the cathode in electrolytic coating processes. In this case, the part is a thin wafer 31 placed on a substrate 32 that comprises an anterior housing 33 with extent and depth adapted to the extent and depth of the wafer 31, such that it can fit with almost no clearance into it and without forming any projection or recess. This type of arrangement enables the electrolyte to flow in front of the cathode holder 30 and the wafer 31. The substrate 32 also comprises a posterior housing 34 with a circular step 35 in which a mechanical star 36 extends, formed from a central hub from which radiating arms 37 spread out and for which the ends bear on the step 35. The arms 37 support sheathed electrical contacts 38 to provide electrical isolation from the electrolyte, and extend firstly obliquely through notches 39 formed around the periphery of the substrate 32, and then forwards before curving in a half turn and finishing at electrically insulating end pieces 40, preferably in the form of a suction cup so that the electrolyte current input onto the wafer 31 can be electrically isolated. Thus, the electrical contacts 38 not only make the electrical connection with the wafer 31, but also make a mechanical attachment by holding it in the housing 33.

Figure 4:
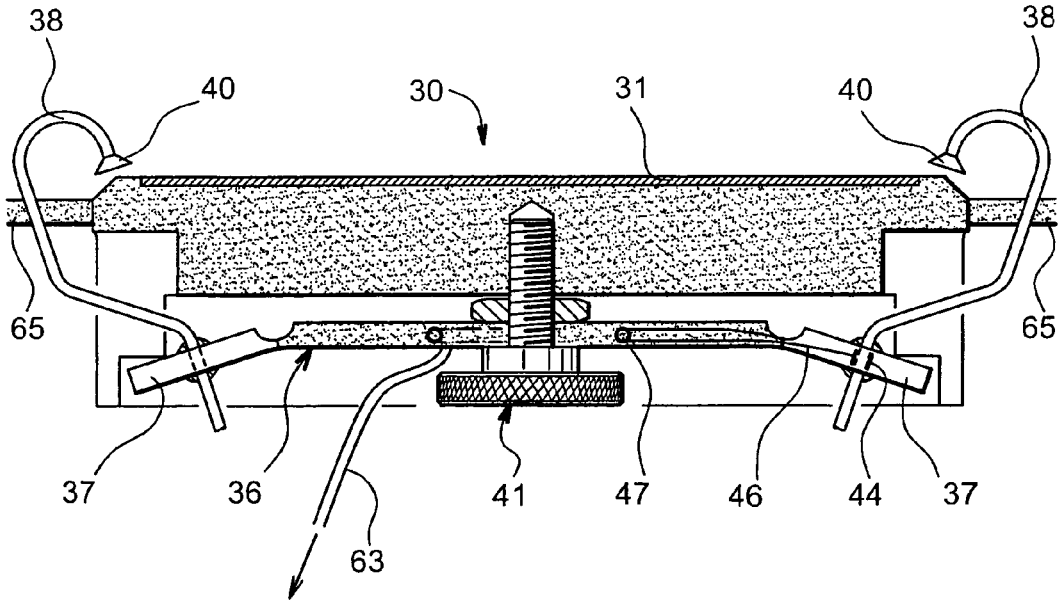

The star 36 carries a screw 41 that is held in it at a constant position and for which rotation in a tapped part 42 of the posterior face of the substrate 32 causes the head to move upwards or downwards and therefore bends the star 36 by the arms 37 pressing on the step 35. This bending is made possible by weak points 43 in the section of the arms 37 that form hinge points. The arrangement is such that as shown in FIG. 4, the penetration of the screw 41 and the bending of the arms 37 of the star 36 cause the electrical contacts 38 to tip, which lifts the ends 40 of the wafer 31 and displaces them outwards, moving away from the wafer 31 that can therefore be removed or replaced.

The number of electrical contacts 38 may vary if they are embedded in the arms 37 by separable and particularly elastic connections. They may also be provided with a deformable button 44 pressed in through drillings of the arms 37 to be held in them at a constant position while maintaining electrical contact with the electrical wires 46 embedded in the arms 37. The electrical wires 46 are connected through a conducting wheel 47 to a common connection wire 63 leading to the negative terminal of the generator 62. The modification to the number of electrical contacts 38 also provides a means of adjusting the electrical current circulation and the electrolyte flow in and in front of the wafer 31.

The cathode holder 30 is held in an armature 64 by arms 65 similar to the arms (25) in the anode 20.

Like the electrical wires 61 and 63, the electrical contacts 38 are sheathed where they are immersed in the electrolyte.

Due to the freedom of the arrangement made possible, particularly due to the fact that the reactor 2 is divided into slices 7, the device proposed herein makes it possible to make fine adjustments to the hydrodynamic and electrical characteristics of the process and therefore to more easily achieve a satisfactory coating on the wafer 31. It is easy to modify the number and arrangement of electrodes, and it is also possible to modify the length and the section of the conical recess 13 by choosing only some of the available slices 7. A more or less pronounced "diaphragm" effect can be created at the cathode, by removing and adding the required number of slices 7. This effect is characterised by the fact that current lines on the cathode edges can be limited and concentrated in the central part.

It will be particularly pronounced if the ratio between the output diameter of the cone and the diameter of the substrate to be coated (the wafer 31) becomes smaller. This ratio can be varied by removing or adding slices 7.

Naturally and in most cases, the electrolytic deposition is made in the form of a dish with more material on the edges than at the centre. Creating a material defect on the edges makes it possible to smooth the profile so that it tends towards a flat profile, therefore improving the homogeneity of the deposit.

When the device has a given configuration for a given size of the substrate to be coated, the cathode holder 30 is adapted to treat a smaller substrate, and slices 7 can be removed until the desired effect is obtained:

diaphragm effect with a small taper angle;

normal flow with large taper angle.

Similarly, slices can be added to obtain a diaphragm effect on a larger substrate.

The stack is compressed by the mobile carriage 23 free to move on the racks 22.

The small taper angle (about 2020 or less, and preferably about 14° or less) of the recess 13 can give excellent flow uniformity, which is even better if geometric irregularities are small and particularly if the surface of the recess 13 is very smooth; flow turbulence is then almost non-existent.

It must be added that it is still possible to fix the wafer 31 by suction on the cathode holder 30.

Finally, the magnetic polarisation magnets 66 in the wafer 31 can easily be housed in the armature 64, in the cathode holder 30 or around the reactor 2 provided that they are placed such that they magnetically orient the material deposited on the wafer 31.

The single nozzle 11 can be replaced by a stack of removable slices 7 making up an adjustable nozzle.

The electrolyte injection velocity can be varied to modify the flow conditions and the electrolyte flow on the wafer 31.

Those skilled in the art will choose electrically insulating, chemically inert, hydrophilic materials with good mechanical strength for the tank 1, reactor 2, etc.

An electrolyte retention tank may be placed on the pipe 4 on the output side of the pump to adjust the electrolyte level in the tank 1, particularly when the reactor 2 is replaced by adding or removing wafers 7, to empty the tank 1 or to fill it. Valves leading to the nozzle 11 and to the retention tank are switched to allow the electrolyte to flow freely into tank 1, or to discharge the electrolyte into the tank, or to enable normal flow in closed circuit inside pipe 4.

Some improvements to the previous embodiments are given in the final figures. FIG. 5 illustrates a slice 70 different from the previous slice due to the presence of three notches 71 replacing the two notches 26 and now placed at 120° from each other radiating inwards to receive an anode not shown provided with three radiating arms 25 instead of two, as in the previous embodiment. This device alone would prevent accidental rotation of the anode, and better than would be possible with the pins 60 that are not shown in this case.

In particular, the slice 70 is provided with grooves 72 at its vertex, and a portion 73 of the grooves 72 is free and another portion 74 is formed with a hook-shaped cavity, like that shown in FIG. 6 that shows a cross-section through this portion. The grooves 72 make it possible to insert a handle 75 (FIG. 7) comprising a pair of vertical slices 76 penetrating into the portions 73 and a pair of pins 77 aligned with each other penetrating in the portions 74. When the handle 75 is engaged in the grooves 72 and raised, it extracts the slice 70.

Figure 8:
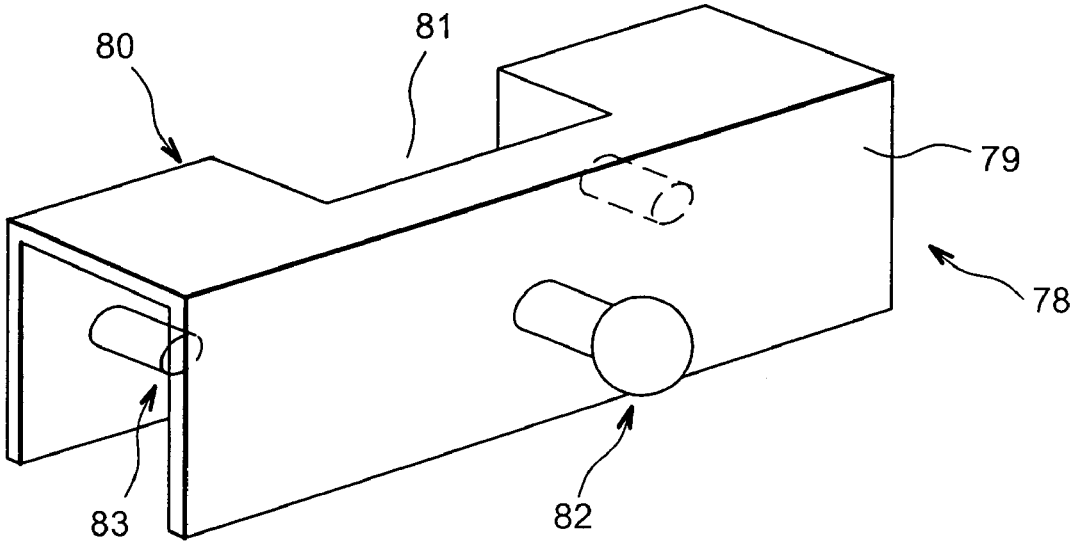
FIG. 8 illustrates a disassembly slide.

It has been observed that this extraction caused serious practical problems due to the propensity of the slices 7 or 70 to bond together when they are wet. With the device described above, the slices can be extracted more easily but it cannot be used in itself to separate them, such that several can be extracted at the same time. The device in FIG. 8 is then used; it consists of a slide 78 provided with two flanges 79 and 80, the second of which is separated by a slit 81. The flange 79 is provided with a wheel 82 and the two halves of the flange 80 are each fitted with a pin 83.

Figure 9:
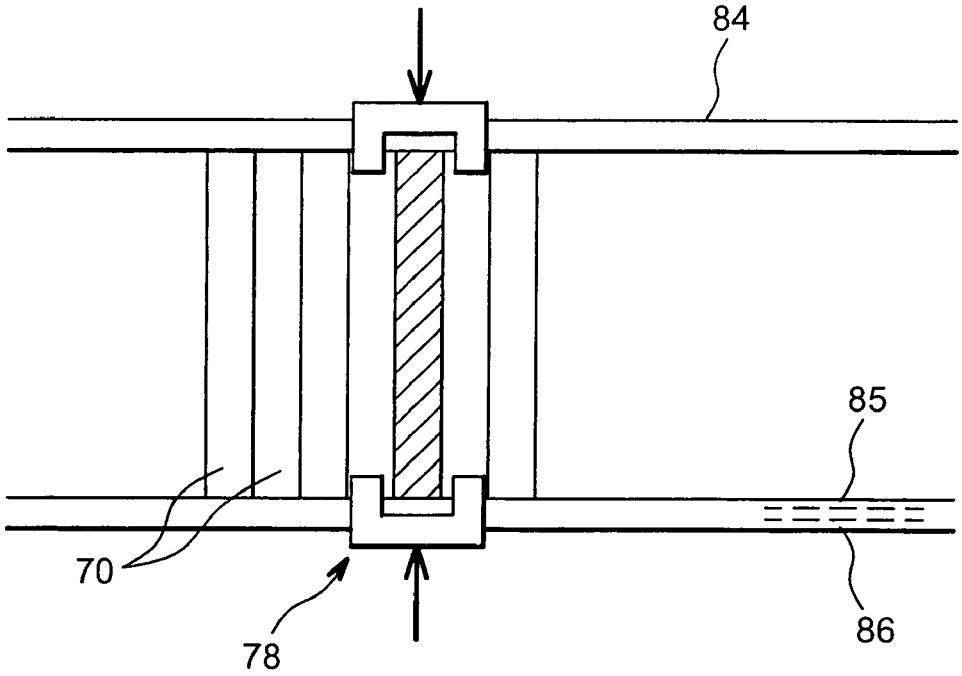
FIG. 9 illustrates use of this slide.

In this case (FIG. 9), the reactor comprises sidewalls 84 each with a pair of grooves 85 and 86 close to their upper edges. When a slice 70 has to be extracted, the top face of the tank is removed and the slides 78 are installed on the sidewalls 84 such that their pins 83 enter the groove 85 on the inside and the wheels 82 of the groove 86 on the outside. It is then possible to move the slides 78 along the stack of slices 70, stop them in front of the slice 70 to be extracted and retain them by rotating the wheel 82 which makes it rub in contact with the walls 84. The handle 75 then slides in the grooves 72 of the slice concerned, which is extracted by passing through the slits 81. The slides 78 retain the adjacent slices.

The invention claimed is:

1. An electrolytic reactor for use in a process for electrolytically coating a part, comprising:

a conical chamber open at two opposite ends;

a support for the part to be coated, the support being placed in the chamber towards a wide end of the chamber;

an anode placed in the chamber towards a narrow end of the chamber; and means for circulating the electrolyte through the chamber from the narrow end to the wide end, wherein the chamber includes stacked and removable slices and an armature for supporting and clamping the slices.

2. An electrolytic reactor according to claim 1, wherein at least one of the slices contains at least a cavity in which the support can be placed.

3. An electrolytic reactor according to claim 1, wherein a taper angle of the conical chamber is less than 20° and uniform.

4. An electrolytic reactor according to claim 3, wherein circulating of the electrolyte is coaxial with the conical chamber within a tank containing the chamber, and comprising an electrolyte circuit looping back into the tank.

5. An electrolytic reactor according to claim 4, wherein the electrolyte circuit is connected to the narrow end of the chamber through a nozzle with a conical opening prolonging the chamber.

6. An electrolytic reactor according to claim 1, wherein the support of the part to be coated comprises electrical contacts for cathode polarization of the part arranged around the support and that include a free end pressed in contact on the part, and a connection end extending on a support face opposite the part.

7. An electrolytic reactor according to claim 6, wherein the connection ends of the electrical contacts are connected to flexible arms of a star connector, fixed to the support by a mechanism with variable spacing, and wherein the support includes stops on which the flexible arms bend, and the electrical contacts are in a form of curved hooks standing up on the flexible arms.

8. An electrolytic reactor according to claim 1, wherein the support of the part comprises a housing with a periphery and depth adjusted to the part.

9. An electrolytic reactor according to claim 1, wherein the support of the part is installed removably on an armature delimiting the conical chamber.

10. An electrolytic reactor according to claim 1, wherein the conical chamber, the support of the part to be coated, the part itself, and the anode are coaxial.

11. An electrolytic reactor according to claim 5, wherein the nozzle also includes stacked and removable slices.

12. An electrolytic reactor according to claim 1, wherein the slices are provided with individual extraction means.

13. An electrolytic reactor according to claim 12, further comprising slides free to move in grooves of sidewalls of the tank and recessed above a slice to be extracted.

14. An electrolytic reactor according to claim 2, wherein the slice comprises at least three radiating anode support arm cavities.

15. An electrolytic reactor for use in a process for electrolytically coating a part, comprising:

a conical chamber open at two opposite ends;

a support for the part to be coated, the support being placed in the chamber toward a wide end of the chamber;

an anode placed in the chamber towards a narrow end of the chamber; and means for circulating the electrolyte through the chamber from the narrow end to the wide end, wherein the chamber includes stacked and removable slices and an armature for supporting and clamping the slices, the conical chamber, the support of the part to be coated, the part and the anode are coaxial, wherein the support of the part includes a central substrate for receiving the part and radial arms extending between one of the slices and the central support.

16. An electrolytic reactor according to claim 15, wherein at least one of the slices contains at least a cavity in which the support can be placed.

17. An electrolytic reactor according to claim 15, wherein a taper angle of the conical chamber is less than 20° and uniform.

18. An electrolytic reactor according to claim 17, wherein circulating of the electrolyte is coaxial with the conical chamber within a tank containing the chamber, and comprising an electrolyte circuit looping back into the tank.

19. An electrolytic reactor according to claim 18, wherein the electrolyte circuit is connected to the narrow end of the chamber through a nozzle with a conical opening prolonging the chamber.

20. An electrolytic reactor according to claim 15, wherein the support of the part to be coated comprises electrical contacts for cathode polarization of the part arranged around the support and that include a free end pressed in contact on the part, and a connection end extending on a support face opposite the part.

21. An electrolytic reactor according to claim 20, wherein the connection ends of the electrical contacts are connected to flexible arms of a star connector, fixed to the support by a mechanism with variable spacing, and wherein the support includes stops on which the flexible arms bend, and the electrical contacts are in a form of curved hooks standing up on the flexible arms.

22. An electrolytic reactor according to claim 15, wherein the support of the part comprises a housing with a periphery and depth adjusted to the part.

23. An electrolytic reactor according to claim 15, wherein the support of the part is installed removably on an armature delimiting the conical chamber.

24. An electrolytic reactor according to claim 19, wherein the nozzle also includes stacked and removable slices.

25. An electrolytic reactor according to claim 15, wherein the slices are provided with individual extraction means.

26. An electrolytic reactor according to claim 25, further comprising slides free to move in grooves of sidewalls of the tank and recessed above a slice to be extracted.

27. An electrolytic reactor according to claim 16, wherein the slice includes at least three radiating anode support arm cavities.

* * * * *